US010921840B2

(12) United States Patent
Hwang

(10) Patent No.: US 10,921,840 B2
(45) Date of Patent: Feb. 16, 2021

(54) VOLTAGE GENERATOR, SEMICONDUCTOR APPARATUS AND SEMICONDUCTOR SYSTEM USING THE VOLTAGE GENERATOR

(71) Applicant: SK hynix Inc., Icheon-si (KR)

(72) Inventor: Tae Jin Hwang, Seoul (KR)

(73) Assignee: SK hynix Inc., Icheon-si (KR)

( * ) Notice: Subject to any disclaimer, the term of this patent is extended or adjusted under 35 U.S.C. 154(b) by 0 days.

(21) Appl. No.: 16/673,289

(22) Filed: Nov. 4, 2019

(65) Prior Publication Data

US 2020/0326741 A1 Oct. 15, 2020

(30) Foreign Application Priority Data

Apr. 15, 2019 (KR) ..... 10-2019-0043622

(51) Int. Cl.
*G05F 3/26* (2006.01)

(52) U.S. Cl.
CPC ..... *G05F 3/262* (2013.01)

(58) Field of Classification Search
CPC ..... G05F 3/262; G05F 3/26
See application file for complete search history.

(56) References Cited

U.S. PATENT DOCUMENTS 6,087,894 A * 7/2000 Barrett, Jr. ..... G05F 3/262 323/315
6,351,177 B1 * 2/2002 Lin ..... G05F 3/262 323/315
6,753,724 B2 * 6/2004 Hanson ..... G05F 3/262 323/315
6,831,492 B1 * 12/2004 Abbasi ..... H03L 7/0812 327/158
6,903,586 B2 * 6/2005 Abbasi ..... H03L 7/0812 327/149
7,057,445 B2 * 6/2006 Hayakawa ..... G05F 3/205 323/315
7,893,744 B2 * 2/2011 Nakamura ..... H03K 5/00006 327/175
8,093,952 B2 * 1/2012 Behzad ..... H03F 1/301 330/285
8,115,559 B2 * 2/2012 Kim ..... H03K 3/0322 331/17
8,836,313 B2 * 9/2014 Takagi ..... G05F 3/262 323/314
9,112,502 B2 8/2015 Sugahara
9,438,205 B2 * 9/2016 Kim ..... H03L 1/022
9,690,316 B2 * 6/2017 Yun ..... G05F 3/262
2009/0085651 A1 * 4/2009 Liu ..... G05F 3/30 327/539
2011/0050197 A1 * 3/2011 Yuasa ..... G05F 3/242 323/313
2014/0203794 A1 * 7/2014 Pietri ..... G05F 3/02 323/313

* cited by examiner

*Primary Examiner* — Thomas J. Hiltunen
(74) *Attorney, Agent, or Firm* — William Park & Associates Ltd.

(57) ABSTRACT

A voltage generator includes a bias voltage generation circuit and a compensation circuit. The bias voltage generation circuit generates a first bias voltage based on a reference current and generates a second bias voltage based on the first bias voltage. The compensation circuit changes a voltage level of the first bias voltage based on the second bias voltage.

18 Claims, 4 Drawing Sheets

VOLTAGE GENERATOR, SEMICONDUCTOR APPARATUS AND SEMICONDUCTOR SYSTEM USING THE VOLTAGE GENERATOR

CROSS-REFERENCES TO RELATED APPLICATION

The present application claims priority under 35 U.S.C. § 119(a) to Korean application number 10-2019-0043622, filed on Apr. 15, 2019, in the Korean Intellectual Property Office, which is incorporated herein by reference in its entirety.

BACKGROUND

1. Technical Field

Various embodiments of the present disclosure relate to an integrated circuit technology and, more particularly, to a voltage generator, semiconductor apparatus and semiconductor system using the voltage generator.

2. Related Art

An electronic device includes a lot of electronic elements, and a computer system includes lots of semiconductor apparatuses, each comprising a semiconductor. Semiconductor apparatuses receive various power currents and include various constant current sources. A constant current source is configured to receive a bias current and generate a current of a predetermined amount. In order to generate a constant current of a predetermined amount, it is important to keep a voltage level of the bias voltage constant. Circuits of a semiconductor apparatus, mainly comprising transistors, have characteristics vulnerable to variation of processes, voltages and temperatures. When a threshold voltage of a transistor changes, as processes, voltages, and temperatures vary, the voltage level of the bias voltage may change, and, thus, an intended constant current might not be generated due to the voltage level change of the bias voltage.

SUMMARY

In an embodiment, a voltage generator may include a bias voltage generation circuit and a compensation circuit. The bias voltage generation circuit may be configured to generate a first bias voltage based on a reference current and generate a second bias voltage based on the first bias voltage. The compensation circuit may be configured to change a voltage level of the first bias voltage based on the second bias voltage.

In an embodiment, a voltage generator may include a bias voltage generation circuit and a variable current source. The bias voltage generation circuit may be configured to generate a first bias voltage based on a reference current and generate a second bias voltage based on the first bias voltage. The variable current source may be configured to, based on a voltage level of the second bias voltage, adjust an amperage provided to a node from which the first bias voltage is output.

DETAILED DESCRIPTION

Figure 1:
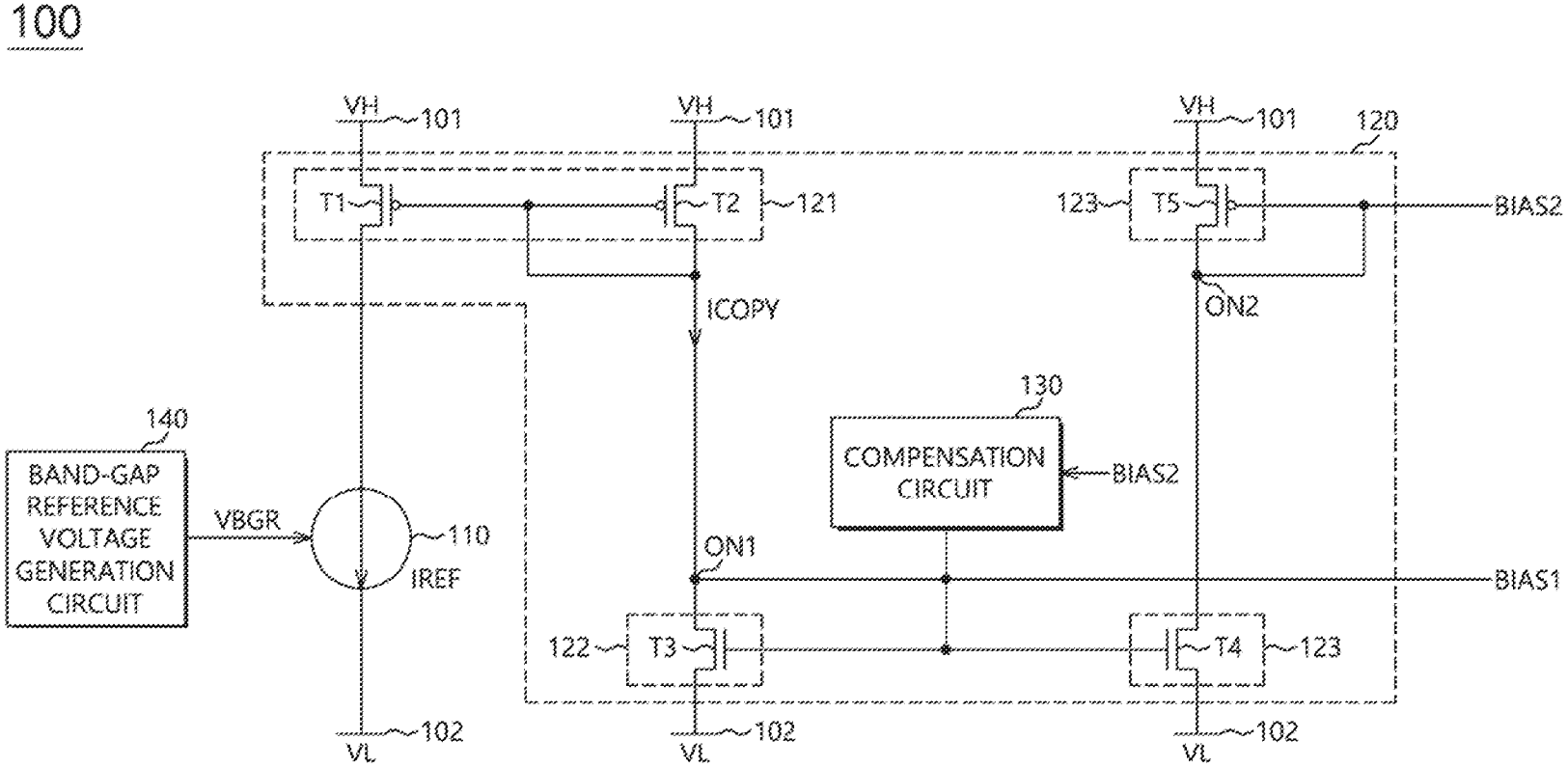
FIG. 1 is a diagram, illustrating a configuration of a voltage generator, in accordance with an embodiment.

The specific structural or functional description disclosed herein is merely illustrative for the purpose of describing embodiments based on the concept of the present disclosure. The embodiments based on the concept of the present disclosure can be implemented in various forms, and cannot be construed as limited to the embodiments set forth herein.

The embodiments based on the concept of the present disclosure can be variously modified and have various shapes. Thus, the embodiments are illustrated in the drawings and are intended to be described herein in detail. However, the embodiments based on the concept of the present disclosure are not construed as limited to specified disclosures, and include all changes, equivalents, or substitutes that do not depart from the spirit and technical scope of the present disclosure.

It will be understood that when an element is referred to as being "connected" or "coupled" to another element, it can be directly connected or coupled to the other element or intervening elements may also be present. In contrast, when an element is referred to as being "directly connected" or "directly coupled" to another element, no intervening elements are present. Meanwhile, other expressions describing relationships between components such as "~ between," "immediately ~ between" or "adjacent to ~" and "directly adjacent to ~" may be construed similarly.

The terms used in the present application are merely used to describe particular embodiments, and are not intended to limit the present disclosure. Singular forms in the present disclosure are intended to include the plural forms as well, unless the context clearly indicates otherwise.

So far as not being differently defined, all terms used herein including technical or scientific terminologies have meanings that they are commonly understood by those skilled in the art to which the present disclosure pertains.

In describing those embodiments, description will be omitted for techniques that are well known to the art to which the present disclosure pertains, and are not directly related to the present disclosure.

Hereinafter, exemplary embodiments of the present disclosure will be described in detail with reference to the accompanying drawings in order for those skilled in the art to be able to readily implement the technical spirit of the present disclosure.

Hereinafter, a semiconductor apparatus based on the present disclosure will be described below, with reference to the accompanying drawings, through various embodiments.

FIG. 1 is a diagram, illustrating a configuration of a voltage generator 100, in accordance with an embodiment. Referring to FIG. 1, the voltage generator 100 may receive a reference current IREF and may generate a first bias voltage BIAS1 and a second bias voltage BIAS2. The reference current IREF may be a constant current having a predetermined amperage. The amperage may mean an amount of current. The voltage generator 100 may generate the first bias voltage BIAS1 based on the reference current IREF. And the voltage generator 100 may generate the second bias voltage BIAS2 based on the first bias voltage BIAS1. When the voltage level of the first bias voltage BIAS1 changes, the voltage generator 100 may change the voltage level of the second bias voltage BIAS2. The voltage generator 100 may generate the first bias voltage BIAS1 and the second bias voltage BIAS2, with predetermined voltage levels, by changing the voltage level of the second bias voltage BIAS2, based on the voltage level of the first bias voltage BIAS1 and by changing the voltage level of the first bias voltage BIAS1 based on the voltage level of the second bias voltage BIAS2. Particularly, even when the variation of the process and/or temperature affects the transistors' threshold voltage changes, which in turn, affects the voltage levels of the first bias voltage BIAS1 and the second bias voltage BIAS2, the voltage generator 100 may compensate for the voltage level changes of the first bias voltage BIAS1 and the second bias voltage BIAS2.

The word "predetermined" as used herein with respect to a parameter, such as a predetermined amount, means that a value for the parameter is determined prior to the parameter being used in a process or algorithm. For some embodiments, the value for the parameter is determined before the process or algorithm begins. In other embodiments, the value for the parameter is determined during the process or algorithm but before the parameter is used in the process or algorithm.

Referring to FIG. 1, the voltage generator 100 may include a reference current source 110, a bias voltage generation circuit 120, a compensation circuit 130, and a band-gap reference voltage generation circuit 140. The reference current source 110 may receive at least one reference voltage VBGR and may generate the reference current IREF having the predetermined amount of amperage. The at least one reference voltage VBGR may be a band-gap reference voltage, having a predetermined voltage level. The voltage generator 100 may further include the band-gap reference voltage generation circuit 140, configured to generate the at least one reference voltage VBGR. The band-gap reference voltage generation circuit 140 may generate the band-gap reference voltage, having a predetermined voltage level, regardless of the variation of the process and/or temperature. The band-gap reference voltage generation circuit 140 may be implemented based on any known circuit for outputting a reference voltage. In an embodiment, the band-gap reference voltage generation circuit 140 may generate two or more reference voltages, and the reference current source 110 may generate the reference current IREF, based on the two or more reference voltages.

The bias voltage generation circuit 120 may be electrically coupled to the reference current source 110 and may receive the reference current IREF. As previously disclosed, the bias voltage generation circuit 120 may generate the first bias voltage BIAS1 based on the reference current IREF and may generate the second bias voltage BIAS2 based on the first bias voltage BIAS1. The bias voltage generation circuit 120 may determine the voltage level of the first bias voltage BIAS1 based on the amperage of the reference current IREF and may determine the voltage level of the second bias voltage BIAS2 based on the voltage level of the first bias voltage BIAS1.

The compensation circuit 130 may receive the second bias voltage BIAS2 and may change the voltage level of the first bias voltage BIAS1 based on the voltage level of the second bias voltage BIAS2. When the voltage level of the first bias voltage BIAS1 changes, the voltage level of the second bias voltage BIAS2 may also change. Therefore, the compensation circuit 130 may maintain the voltage levels of the first bias voltage BIAS1 and the second bias voltage BIAS2 at the predetermined voltage levels by compensating for the voltage level change of the first bias voltage BIAS1 based on the second bias voltage BIAS2.

Referring to FIG. 1, the bias voltage generation circuit 120 may include a current duplication circuit 121, a first bias voltage output circuit 122 and a second bias voltage output circuit 123. The current duplication circuit 121 may generate a duplicated current ICOPY by duplicating the reference current IREF. The duplicated current ICOPY may have substantially the same amperage as the reference current IREF. The first bias voltage output circuit 122 may generate the first bias voltage BIAS1 based on the duplicated current ICOPY. The first bias voltage output circuit 122 may change the voltage level of the first bias voltage BIAS1 based on the amperage of the duplicated current ICOPY. The second bias voltage output circuit 123 may generate the second bias voltage BIAS2 based on the first bias voltage BIAS1. The second bias voltage output circuit 123 may change the voltage level of the first bias voltage BIAS1 based on the voltage level of the second bias voltage BIAS2.

The current duplication circuit 121 may include a first transistor T1 and a second transistor T2. The first transistor T1 and the second transistor T2 may be P-channel MOS transistors. The first transistor T1 may be electrically coupled between a first power voltage terminal 101 and the reference current source 110. The reference current source 110 may be electrically coupled between the first transistor T1 and a second power voltage terminal 102. A first power voltage VH may be provided to the first power voltage terminal 101 and a second power voltage VL may be provided to the second power voltage terminal 102. The first power voltage VH may have a higher voltage level than the second power voltage VL. For example, the first power voltage VH may be an operational power voltage for the voltage generator 100, and the second power voltage VL may be a ground voltage. The second transistor T2 may be electrically coupled between the first power voltage terminal 101 and a first output node ON1. The first bias voltage BIAS1 may be output through the first output node ON1. Gates of the first transistor T1 and the second transistor T2 may be electrically coupled in common to the reference current source 110. The first transistor T1 and the second transistor T2 may have a coupling structure of a current mirror and may allow the duplicated current ICOPY, having a amperage corresponding to the reference current IREF, to flow from the second transistor T2 to the first output node ON1.

The first bias voltage output circuit 122 may include a third transistor T3. The third transistor T3 may be an N-channel MOS transistor. The third transistor T3 may be electrically coupled between the first output node ON1 and the second power voltage terminal 102. The first output node ON1 may be electrically coupled to the gate of the third transistor T3. As the duplicated current ICOPY is applied to the first output node ON1, the voltage level of the first output node ON1 may increase. When the third transistor T3 is fully turned on, the current flowing from the first output node ON1 to the second power voltage terminal 102 may increase to its maximum amperage, thereby allowing for the determination of the voltage level of the first bias voltage BIAS1.

The second bias voltage output circuit 123 may include a fourth transistor T4 and a fifth transistor T5. The fourth transistor T4 may be a N-channel MOS transistor and the fifth transistor T5 may be a P-channel MOS transistor. The fourth transistor T4 may be electrically coupled between a second output node ON2 and the second power voltage terminal 102. The second bias voltage BIAS2 may be output through the second output node ON2. The gate of the fourth transistor T4 may be electrically coupled to the first output node ON1. The fifth transistor T5 may be electrically coupled between the first power voltage terminal 101 and the second output node ON2. The gate of the fifth transistor T5 may be electrically coupled to the second output node ON2. When the fourth transistor T4 is fully turned on in response to the first bias voltage BIAS1, the voltage level of the second output node ON2 may be determined. In turn, the fifth transistor T5 may be turned on based on the voltage level of the second output node ON2. When a current flowing to the second output node ON2 through the fifth transistor T5 and a current flowing through the fourth transistor T4 establish their equilibrium, the voltage level of the second bias voltage BIAS2 may be determined.

The compensation circuit 130 may be electrically coupled to the first output node ON1. The compensation circuit 130 may receive the second bias voltage BIAS2 through the second output node ON2. The compensation circuit 130 may change the voltage level of the first bias voltage BIAS1 by changing the voltage level of the first output node ON1, based on the voltage level of the second bias voltage BIAS2. The compensation circuit 130 may change the voltage level of the first bias voltage BIAS1 by adjusting the amperage applied to the first output node ON1, based on the second bias voltage BIAS2. The compensation circuit 130 may be a variable current source configured to change the amount of current that is applied to the first output node ON1, based on the second bias voltage BIAS2. For example, as the voltage level of the second bias voltage BIAS2 increases, the compensation circuit 130 may raise the voltage level of the first bias voltage BIAS1 by increasing the amount of current applied to the first output node ON1. On the other hand, as the voltage level of the second bias voltage BIAS2 decreases, the compensation circuit 130 may decrease the voltage level of the first bias voltage BIAS1 by decreasing the amount of current applied to the second output node ON2.

Figure 2:
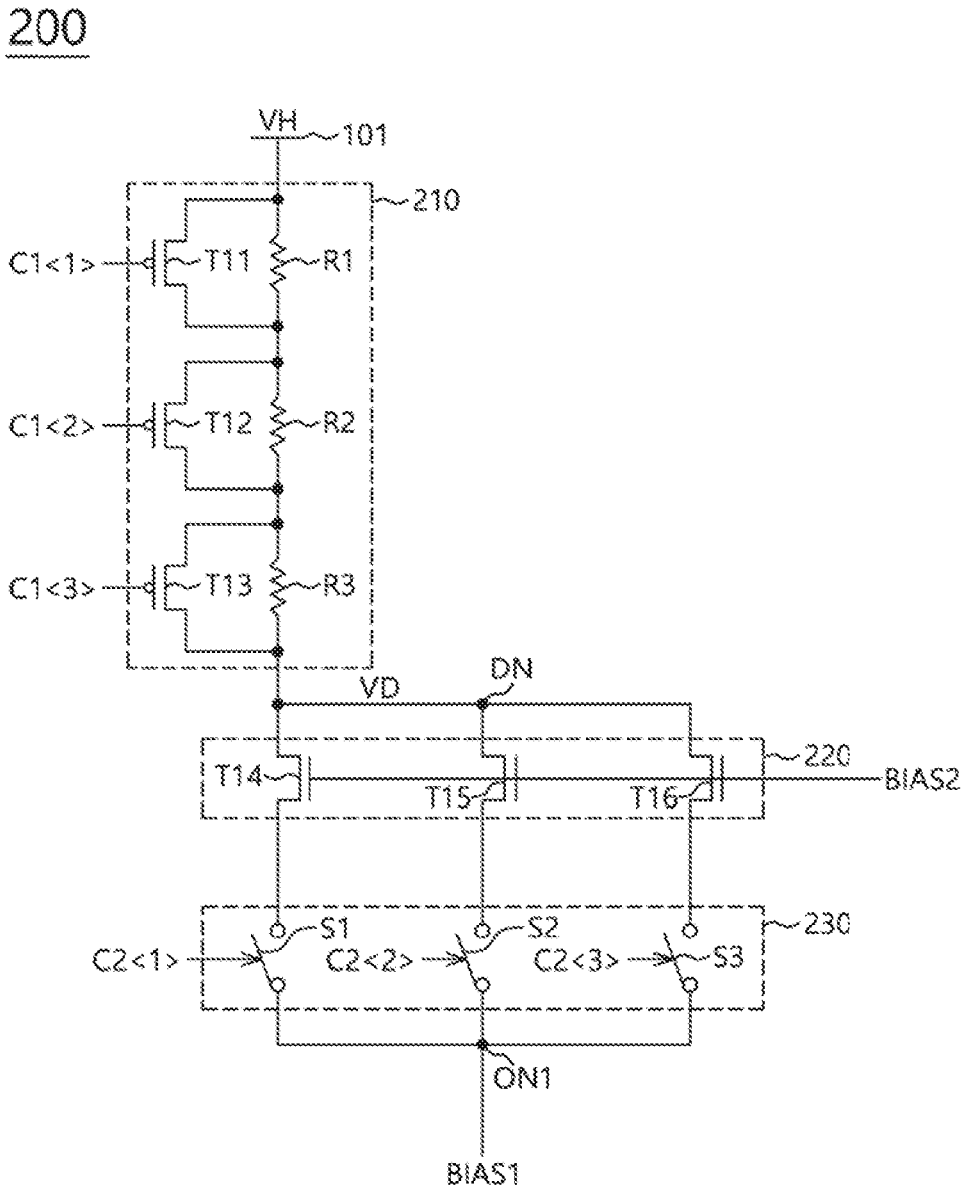
FIG. 2 is a diagram, illustrating a configuration of a compensation circuit, in accordance with an embodiment.

FIG. 2 is a diagram illustrating a configuration of a compensation circuit 200 in accordance with an embodiment. The compensation circuit 200 may be implemented as the compensation circuit 130 of FIG. 1. The compensation circuit 200 may receive the second bias voltage BIAS2 and may change the voltage level of the first bias voltage BIAS1. The compensation circuit 200 may further receive first control signals C1<1:3> and second control signals C2<1:3>. The first control signals C1<1:3> and the second control signals C2<1:3> may be any control signal, provided in conjunction with the second bias voltage BIAS2, to adjust the amperage provided by the compensation circuit 200. The compensation circuit 200 may adjust the voltage level of the first bias voltage BIAS1 based on the second bias voltage BIAS2, the first control signals C1<1:3> and the second control signals C2<1:3>. Although FIG. 2 illustrates an embodiment with first control signals C1<1:3> and second control signals C2<1:3> with 3 bits, respectively, the number of bits included in the respective first control signals C1<1:3> and second control signals C2<1:3> may be greater than or less than 3. Furthermore, the number of bits included in the first control signals C1<1:3> may be different from the number of bits included in the second control signals C2<1:3>.

Figure 3:
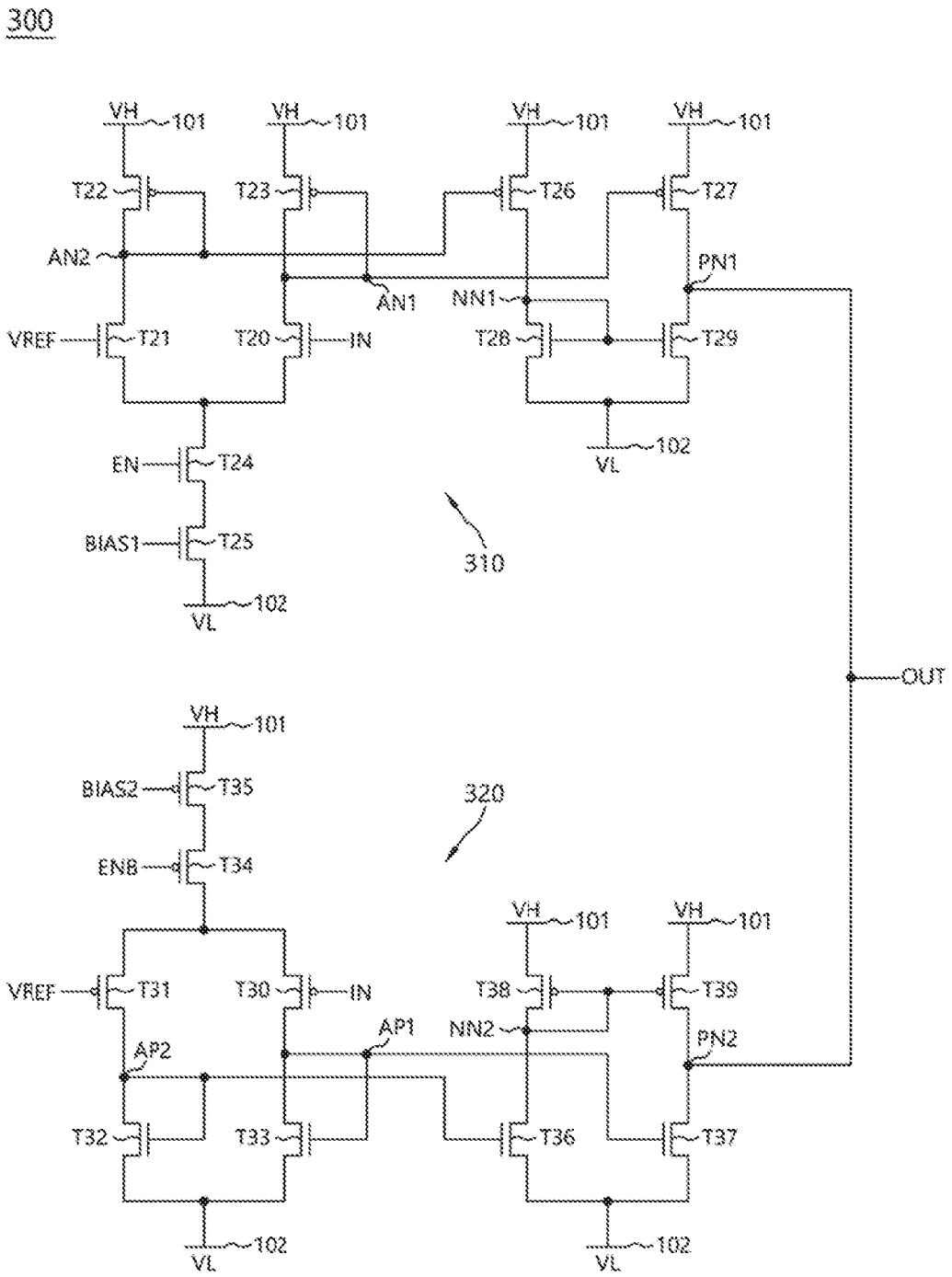
FIG. 3 is a diagram, illustrating a configuration of a reception circuit, in accordance with an embodiment.

The compensation circuit 200 may include a voltage division circuit 210, a current circuit 220 and a switching circuit 230. The voltage division circuit 210 may generate a division voltage VD by dividing the first power voltage VH based on the first control signals C1<1:3>. The division voltage VD may be output through a division node DN. The voltage division circuit 210 may include a plurality of resistances electrically coupled to each other, in series, between the first power voltage terminal 101 and the division node DN, and a plurality of transistors, electrically coupled to the plurality of resistances, respectively, in parallel. For example, the plurality of transistors may be P-channel MOS transistors. Each respective transistor of the plurality of transistors may be assigned to receive one of the first control signals C1<1:3>. Although FIG. 3 illustrates an embodiment with a voltage division circuit 210 comprising 3 resistances and 3 transistors, the numbers of the resistances and the numbers of transistors may be greater or less than 3 and might not be equal to one another. A first resistance R1 may be electrically coupled to the first power voltage terminal 101 at its first end. A second resistance R2 may be electrically coupled to a second end of the first resistance R1 at a first end. A third resistance R3 may be electrically coupled to a second end of the second resistance R2 at its first end and to the division node DN at its second end. The gate of the first transistor T11 may be electrically coupled to the first resistance R1, in parallel, and may receive the first control signal C1<1>. The gate of the second transistor T12 may be electrically coupled to the second resistance R2, in parallel, and may receive the first control signal C1<2>. The gate of the third transistor T13 may be electrically coupled to the third resistance R3, in parallel, and may receive the first control signal C1<3>. The voltage division circuit 210 may variably decrease the voltage level of the first power voltage VH by turning on or turning off a part of or all of the first to third transistors T11, T12 and T13 based on the first control signals C1<1:3>. The voltage division circuit 210 may output the variably decreased first power voltage VH as the division voltage VD.

The current circuit 220 may receive the division voltage VD. The current driving ability of the current circuit 220 may be adjusted based on the second bias voltage BIAS2. The current driving ability of the current circuit 220 may increase as the voltage level of the second bias voltage BIAS2 increases. The current driving ability of the current circuit 220 may decrease as the voltage level of the second bias voltage BIAS2 decreases. Based on the second control signals C2<1:3>, the switching circuit 230 may provide the first output node ON1, to which the first bias voltage BIAS1 is output, with a current provided from the current circuit 220. The switching circuit 230 may adjust the amount of the current provided from the current circuit 220 to the first output node ON1 based on the second control signals C2<1:3>.

The current circuit 220 may include a plurality of transistors. Each of the plurality of transistors may be electrically coupled between the division node DN and the first output node ON1. The plurality of transistors may receive the second bias voltage BIAS2 at their gates in common. For example, the plurality of transistors may be N-channel MOS transistors. The switching circuit 230 may include a plurality of switches. The plurality of switches may receive the second control signals C2<1:3> respectively assigned thereto. The plurality of switches may electrically couple the plurality of transistors of the current circuit 220 and the first output node ON1 based on the second control signals C2<1:3>, respectively. The current circuit 220 may include a first transistor T14, a second transistor T15 and a third transistor T16. The switching circuit 230 may include a first switch S1, a second switch S2 and a third switch S3. Although FIG. 2 illustrates an embodiment with a current circuit 220 including 3 transistors and the switching circuit 230 including 3 switches, the numbers of the transistors included in the current circuit 220 and the numbers of the switches included in the switching circuit 230 may be greater or less than 3 and might not be equal to each other. The first transistor T14 may be electrically coupled between the division node DN and a first end of the first switch S1. The gate of the first transistor T14 may receive the second bias voltage BIAS2. The first switch S1 may receive the second control signal C2<1>. The first switch S1 may be electrically coupled to the first output node ON1 at its second end. The gate of the second transistor T15 may be electrically coupled between the division node DN and a first end of the second switch S2. The second transistor T15 may receive the second bias voltage BIAS2. The second switch S2 may receive the second control signal C2<2>. The second switch S2 may be electrically coupled to the first output node ON1 at its second end. The third transistor T16 may be electrically coupled between the division node DN and a first end of the third switch S3. The gate of the third transistor T16 may receive the second bias voltage BIAS3.

The third switch S3 may receive the second control signal C2<3>. The third switch S3 may be electrically coupled to the first output node ON1 at its second end. The switching circuit 230 may change the current driving ability of the first to third transistors T14, T15 and T16 based on the voltage level of the second bias voltage BIAS2. Furthermore, the switching circuit 230 may adjust, based on the second control signals C2<1:3>, the amount of the current provided from the current circuit 220 to the first output node ON1.

Hereinafter, the voltage generator 100 will be described, with reference to FIGS. 1 and 2, in accordance with an embodiment of the present disclosure. When the at least one reference voltage VBGR is output from the band-gap reference voltage generation circuit 140, the reference current IREF may flow through the reference current source 110. The current duplication circuit 121 may generate the duplicated current ICOPY by duplicating the reference current IREF. The first bias voltage output circuit 122 may generate the first bias voltage BIAS1, having a target voltage level, based on the duplicated current ICOPY. The second bias voltage output circuit 123 may generate the second bias voltage BIAS2, having a target voltage level, based on the first bias voltage BIAS1.

The threshold voltages of transistors, configuring the voltage generator 100, may change due to the variation of the process and/or the temperature. For example, the threshold voltages of N-channel MOS transistors may change due to the variation of temperature after the fabrication of the semiconductor apparatus. When the temperature rises to become higher than room temperature, a threshold voltage of a N-channel MOS transistor may decrease and thus the threshold voltages of the third transistor T3 and the fourth transistor T4 may decrease. As the threshold voltage of the third transistor T3 decreases, the amperage, flowing through the third transistor T3, may increase and the voltage level of the first bias voltage BIAS1 may become lower than its target voltage level. As the voltage level of the first bias voltage BIAS1 decreases, the amperage, flowing through the fourth transistor T4, may decrease, the voltage level of the second output node ON2 may increase and the voltage level of the second bias voltage BIAS2 may become higher than its target voltage level. The compensation circuit 130 may increase the amperage provided to the first output node ON1 based on the raised voltage level of the second bias voltage BIAS2. Therefore, the voltage level of the first bias voltage BIAS1 may increase back to its target voltage level. Also, as the voltage level of the first bias voltage BIAS1 rises back to its target voltage level, the voltage level of the second bias voltage BIAS2 may decrease back to its target voltage level.

When the temperature decreases to become lower than a room temperature, a threshold voltage of a N-channel MOS transistor may rise and thus the threshold voltages of the third transistor T3 and the fourth transistor T4 may rise. As the threshold voltage of the third transistor T3 rises, the amperage flowing through the third transistor T3 may decrease and the voltage level of the first bias voltage BIAS1 may become higher than its target voltage level. As the voltage level of the first bias voltage BIAS1 increase, the amperage flowing through the fourth transistor T4 may increase, the voltage level of the second output node ON2 may decrease and the voltage level of the second bias voltage BIAS2 may become lower than its target voltage level. The compensation circuit 130 may decrease the amperage provided to the first output node ON1 based on the decreased voltage level of the second bias voltage BIAS2. Therefore, the voltage level of the first bias voltage BIAS1 may decrease back to its target voltage level. Furthermore, as the voltage level of the first bias voltage BIAS1 decreases back to its target voltage level, the voltage level of the second bias voltage BIAS2 may increase back to its target voltage level.

The bias voltage generation circuit 120 may change the voltage level of the second bias voltage BIAS2 based on the voltage level of the first bias voltage BIAS1. The compensation circuit 130 may adjust the voltage level of the first bias voltage BIAS1 based on the voltage level of the second bias voltage BIAS2. Therefore, the voltage generator 100, in accordance with an embodiment of the present disclosure, may be configured to generate the first bias voltage BIAS1 and the second bias voltage BIAS2, having predetermined voltage levels, by allowing the first bias voltage BIAS1 and the second bias voltage BIAS2 to compensate for each other's voltage levels.

FIG. 3 is a diagram, illustrating a configuration of a reception circuit 300, in accordance with an embodiment. Referring to FIG. 3, the reception circuit 300 may receive an input signal IN and may generate an output signal OUT. The reception circuit 300 may generate the output signal OUT by differentially amplifying the input signal IN. For a differential amplification operation, the reception circuit 300 may receive the first bias voltage BIAS1 and the second bias voltage BIAS2, generated from the voltage generator 100 illustrated in FIG. 1. The reception circuit 300 may include a constant current source configured to generate a constant current based on the first bias voltage BIAS1 and the second bias voltage BIAS2. The input signal IN may be input as a single ended signal or may be input as a differential signal, together with a complementary signal. When the input signal IN is a single ended signal, the reception circuit 300 may generate the output signal OUT by differentially amplifying the input signal IN and an amplification reference voltage VREF. The amplification reference voltage VREF may have a voltage level corresponding to the middle of a range, within which the input signal IN swings. When the input signal IN is input together with a complementary signal as differential signals, the reception circuit 300 may generate the output signal OUT by differentially amplifying the input signal IN and the complementary signal. Hereinafter, an embodiment of the reception circuit 300, generating the output signal OUT from the input signal IN input as a single ended signal, will be described.

The reception circuit 300 may include a first amplification circuit 310 and a second amplification circuit 320. The first amplification circuit 310 may be a N-type amplifier, comprising a transistor configured to receive the input signal IN, the transistor being a N-channel MOS transistor. The second amplification circuit 320 may be a P-type amplifier, comprising a transistor configured to receive the input signal IN, the transistor being a P-channel MOS transistor. The first amplification circuit 310 may initiatively perform an amplification operation when the input signal IN has a voltage level corresponding to a high level. The second amplification circuit 320 may initiatively perform an amplification operation when the input signal IN has a voltage level corresponding to a low level.

The first amplification circuit 310 may generate the output signal OUT by differentially amplifying the input signal IN and the amplification reference voltage VREF. For the differential amplification operation, the first amplification circuit 310 may receive the first bias voltage BIAS1. The first amplification circuit 310 may include a first transistor T20, a second transistor T21, a third transistor T22, a fourth transistor T23, a fifth transistor T24, a sixth transistor T25, a seventh transistor T26, an eighth transistor T27, a ninth transistor T28 and a tenth transistor T29. The first transistor T20, the second transistor T21, the fifth transistor T24, the sixth transistor T25, the ninth transistor T28 and the tenth transistor T29 may be N-channel MOS transistors. The third transistor T22, the fourth transistor T23, the seventh transistor T26 and the eighth transistor T27 may be P-channel MOS transistors. The first transistor T20 may receive the input signal IN and may change the voltage level of the $1N^{th}$ amplification node AN1. The first transistor T20 may receive the amplification reference voltage VREF and may change the voltage level of the $2N^{th}$ amplification node AN2.

The third transistor T22 may be electrically coupled between the first power voltage terminal 101 and the $2N^{th}$ amplification node AN2. The seventh transistor T26 may be electrically coupled between the first power voltage terminal 101 and a first negative output node NN1. The seventh transistor T26 may be electrically coupled, at its gate, to both of the $2N^{th}$ amplification node AN2 and a gate of the third transistor T22. The seventh transistor T26 may configure, together with the third transistor T22, a current mirror. The third transistor T22 and the seventh transistor T26 may allow a current, which is substantially the same as the current flowing through the $2N^{th}$ amplification node AN2, to flow through the first negative output node NN1. The fourth transistor T23 may be electrically coupled between the first power voltage terminal 101 and the $1N^{th}$ amplification node AN1. The eighth transistor T27 may be electrically coupled between the first power voltage terminal 101 and a first positive output node PN1. The eighth transistor T27 may be coupled, at its gate, to both of the $1N^{th}$ amplification node AN1 and a gate of the fourth transistor T23. The eighth transistor T27 may configure, together with the fourth transistor T23, a current mirror. The fourth transistor T23 and the eighth transistor T27 may allow a current, which is substantially the same as the current flowing through the $1N^{th}$ amplification node AN1, to flow through the first positive output node PN1.

The fifth transistor T24 and the sixth transistor T25 may electrically couple the first transistor T20 and the second transistor T21 to the second power voltage terminal 102. The fifth transistor T24 and the sixth transistor T25 may be electrically coupled to each other, in series, between both the first transistor T20 and the second transistor T21 and the second power voltage terminal 102. The fifth transistor T24 may receive an enable signal EN and may form a current path from the first transistor T20 and the second transistor T21 to the second power voltage terminal 102. The sixth transistor T25 may receive the first bias voltage BIAS1. The sixth transistor T25 may allow, based on the first bias voltage BIAS1, a constant current to flow from the first transistor T20 and the second transistor T21 to the second power voltage terminal 102.

The ninth transistor T28 may be electrically coupled between the first negative output node NN1 and the second power voltage terminal 102. The gate of the ninth transistor T28 may be electrically coupled to the first negative output node NN1. The tenth transistor T29 may be electrically coupled between the first positive output node PN1 and the second power voltage terminal 102. The gate of the tenth transistor T29 may be electrically coupled to the first negative output node NN1. When the input signal IN has a higher voltage level than the amplification reference voltage VREF, the first transistor T20 may be turned on, the amperage flowing through the first transistor T20 may increase and the voltage level of the $1N^{th}$ amplification node AN1 may become lower than the voltage level of the $2N^{th}$ amplification node AN2. Therefore, the voltage level of the first positive output node PN1 may become higher than the voltage level of the first negative output node NN1 and thus the output signal OUT of a high level may be output from the first positive output node PN1.

The second amplification circuit 320 may generate the output signal OUT by differentially amplifying the input signal IN and the amplification reference voltage VREF. For the differential amplification operation, the second amplification circuit 320 may receive the second bias voltage BIAS2. The second amplification circuit 320 may include a first transistor T30, a second transistor T31, a third transistor T32, a fourth transistor T33, a fifth transistor T34, a sixth transistor T35, a seventh transistor T36, an eighth transistor T37, a ninth transistor T38 and a tenth transistor T39. The first transistor T30, the second transistor T31, the fifth transistor T34, the sixth transistor T35, the seventh transistor T36 and the eighth transistor T38 may be P-channel MOS transistors. The third transistor T32, the fourth transistor T33, the ninth transistor T38 and the tenth transistor T39 may be N-channel MOS transistors. The first transistor T30 may receive the input signal IN and may change the voltage level of the $1P^{th}$ amplification node AP1. The first transistor T30 may receive the amplification reference voltage VREF and may change the voltage level of the $2P^{th}$ amplification node AP2.

The third transistor T32 may be electrically coupled between the second power voltage terminal 102 and the $2P^{th}$ amplification node AP2. The seventh transistor T36 may be electrically coupled between the second power voltage terminal 102 and a second negative output node NN2. The seventh transistor T36 may be electrically coupled, at its gate, to both of the $2P^{th}$ amplification node AP2 and a gate of the third transistor T32. The seventh transistor T36 may configure, together with the third transistor T32, a current mirror. The third transistor T32 and the seventh transistor T36 may allow a current, which is substantially the same as a current flowing through the $2P^{th}$ amplification node AP2, to flow through the second negative output node NN2. The fourth transistor T33 may be electrically coupled between the second power voltage terminal 102 and the $1P^{th}$ amplification node AP1. The eighth transistor T37 may be electrically coupled between the second power voltage terminal 102 and a second positive output node PN2. The eighth transistor T37 may be coupled, at its gate, to both of the $1P^{th}$ amplification node AP1 and a gate of the fourth transistor T33. The eighth transistor T37 may configure, together with the fourth transistor T33, a current mirror. The fourth transistor T33 and the eighth transistor T37 may allow a current, which is substantially the same as a current flowing through the $1P^{th}$ amplification node AP1, to flow through the second positive output node PN2.

The fifth transistor T34 and the sixth transistor T35 may electrically couple the first transistor T30 and the second transistor T31 to the first power voltage terminal 101. The fifth transistor T34 and the sixth transistor T35 may be electrically coupled to each other, in series, between both of the first transistor T30 and the second transistor T31 and the first power voltage terminal 101. The fifth transistor T34 may receive a complementary signal ENB of the enable signal EN and may form a current path from the first power voltage terminal 101 to the first transistor T30 and the second transistor T31. The sixth transistor T35 may receive the second bias voltage BIAS2. The sixth transistor T35 may allow, based on the second bias voltage BIAS2, a constant current to flow from the first power voltage terminal 101 to the first transistor T30 and the second transistor T31.

The ninth transistor T38 may be electrically coupled between the second negative output node NN2 and the first power voltage terminal 101. The gate of the ninth transistor T38 may be electrically coupled to the second negative output node NN2. The tenth transistor T39 may be electrically coupled between the second positive output node PN2 and the first power voltage terminal 101. The gate of the tenth transistor T39 may be electrically coupled to the second negative output node NN2. When the input signal IN has a lower voltage level than the amplification reference voltage VREF, the first transistor T30 may be turned on, the amperage flowing through the first transistor T30 may increase, and the voltage level of the $1P^{th}$ amplification node AP1 may become higher than the voltage level of the $2P^{th}$ amplification node AP2. Therefore, the voltage level of the second positive output node PN2 may become lower than the voltage level of the second negative output node NN2 and thus the output signal OUT of a low level may be output from the second positive output node PN2.

When the voltage level of the first bias voltage BIAS1 changes, the current flowing through the sixth transistor T25 may change. Especially, when the voltage level of the first bias voltage BIAS1 decreases, the current may decrease and it may be hard for the voltage level of the $1N^{th}$ amplification node AN1 to become sufficiently low. Therefore, the first amplification circuit 310 might not output the output signal OUT having a sufficiently high level. Also, when the voltage level of the second bias voltage BIAS2 changes, the current flowing through the sixth transistor T35 may change. Especially, when the voltage level of the second bias voltage BIAS2 increases, the current may decrease, and it may be hard for the voltage level of the $1P^{th}$ amplification node AP1 to become sufficiently high. Therefore, the second amplification circuit 320 might not output the output signal OUT having a sufficiently low level. Therefore, for the stable operations of the first amplification circuit 310 and the second amplification circuit 320, it may be important to keep the voltage levels of the first bias voltage BIAS1 and the second bias voltage BIAS2 constant for the constant currents flowing through the sixth transistor T25 and the sixth transistor T35 to be kept constant. In accordance with an embodiment of the present disclosure, the voltage generator 100 may keep the amounts of the constant currents flowing through the sixth transistor T25 and the sixth transistor T35 constant by generating the first bias voltage BIAS1 and the second bias voltage BIAS2 having constant voltage levels regardless of the variation of the threshold voltage of a transistor, and thus may allow the first amplification circuit 310 and the second amplification circuit 320 to perform precise amplification operations.

Figure 4:
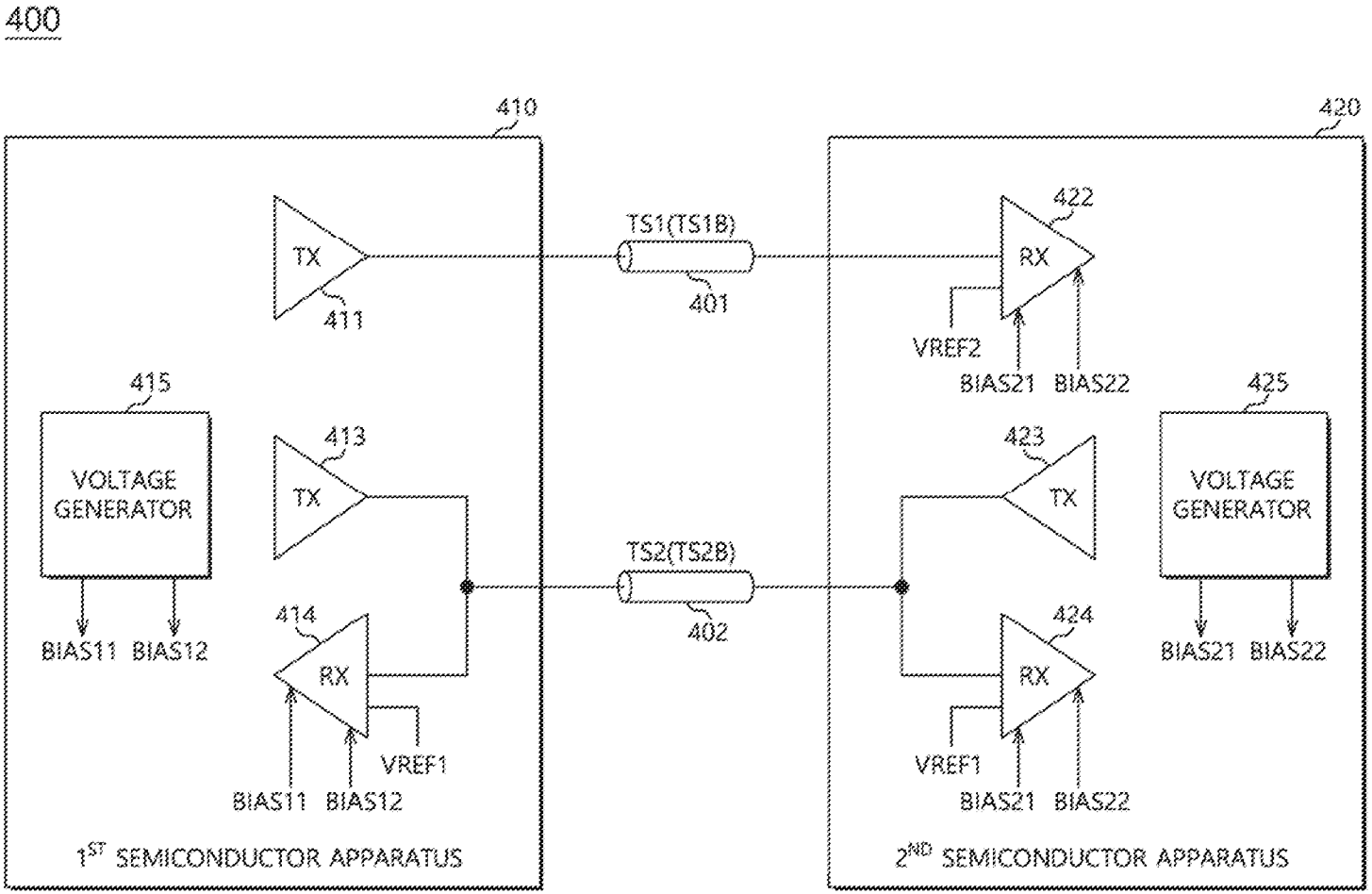
FIG. 4 is a diagram, illustrating a configuration of a semiconductor system, in accordance with an embodiment.

FIG. 4 is a diagram, illustrating a configuration of a semiconductor system 400, in accordance with an embodiment. Referring to FIG. 4, the semiconductor system 400 may include a first semiconductor apparatus 410 and a second semiconductor apparatus 420. The first semiconductor apparatus 410 may provide various control signals, required for the second semiconductor apparatus 420 to perform operations. The first semiconductor apparatus 410 may include host apparatuses of various types. For example, the first semiconductor apparatus 410 may be one or more among a central processing unit (CPU), a graphic processing unit (GPU), a multi-media processor (MMP), a digital signal processor, an application processor (AP) and a memory controller. For example, the second semiconductor apparatus 420 may be a memory apparatus and the memory apparatus may include a volatile memory and a non-volatile memory. The volatile memory may include a static random access memory (static RAM: SRAM) and a dynamic RAM (DRAM), a synchronous DRAM (SDRAM). The non-volatile memory may include a read only memory (ROM), a programmable ROM (PROM), an electrically erasable and programmable ROM (EEPROM), an electrically programmable ROM (EPROM), a flash memory, a phase change RAM (PRAM), a magnetic RAM (MRAM), a resistive RAM (RRAM), a ferroelectric RAM (FRAM) and so forth.

The second semiconductor apparatus 420 may be electrically coupled to the first semiconductor apparatus 410 through a first bus 401 and a second bus 402. Each of the first bus 401 and the second bus 402 may be a signal transmission path, a link or a channel for transferring a signal. The first bus 401 may be a one-way bus. The first semiconductor apparatus 410 may transmit a first signal TS1 to the second semiconductor apparatus 420 through the first bus 401. The second semiconductor apparatus 420 may be electrically coupled to the first bus 401. The second semiconductor apparatus 420 may receive the first signal TS1 transmitted from the first semiconductor apparatus 410 through the first bus 401. The first signal TS1 may include control signals such as a command signal, a clock signal, an address signal, and so forth. The second bus 402 may be a two-way bus. Through the second bus 402, the first semiconductor apparatus 410 may transmit a second signal TS2 to the second semiconductor apparatus 420, and the first semiconductor apparatus 410 may receive the second signal TS2, transmitted from the second semiconductor apparatus 420. Conversely, through the second bus 402, the second semiconductor apparatus 420 may transmit the second signal TS2 to the first semiconductor apparatus 410 through the second bus 402, and the second semiconductor apparatus 420 may receive the second signal TS2, transmitted from the first semiconductor apparatus 410. For example, the second signal TS2 may be data. In an embodiment, the first signal TS1 and the second signal TS2, together with complementary signals TSB1 and TSB2, may be pairs of differential signals, which are transferred through the first bus 401 and the second bus 402. In an embodiment, the first signal TS1 and the second signal TS2 may be single-ended signals, which are transferred through the first bus 401 and the second bus 402.

The first semiconductor apparatus 410 may include a first transmission circuit (TX) 411, a second transmission circuit (TX) 413 and a reception circuit (RX) 414. The first transmission circuit 411 may be electrically coupled to the first bus 401 and may drive, based on an internal signal of the first semiconductor apparatus 410, the first bus 401 to transmit the first signal TS1 to the second semiconductor apparatus 420. The second transmission circuit 413 may be electrically coupled to the second bus 402 and may drive, based on an internal signal of the first semiconductor apparatus 410, the second bus 402 to transmit the second signal TS2 to the second semiconductor apparatus 420. The reception circuit 414 may be electrically coupled to the second bus 402 and may receive the second signal TS2 transmitted from the second semiconductor apparatus 420 through the second bus 402. The reception circuit 414 may generate an internal signal, which is to be used within the first semiconductor apparatus 410, by differentially amplifying the second signal TS2 transmitted through the second bus 402. When a pair of differential signals is transmitted through the second bus 402, the reception circuit 414 may generate the internal signal by differentially amplifying the second signal TS2 and the complementary signal TS2B of the second signal TS2. When a single-ended signal is transmitted through the second bus 402, the reception circuit 414 may generate the internal signal by differentially amplifying the second signal TS2 and a first reference voltage VREF1. The first reference voltage VREF1 may have a voltage level corresponding to the middle of a range, within which the second signal TS2 swings. The amplification circuit 300, illustrated in FIG. 3, may be applied as the reception circuit 414. The first semiconductor apparatus 410 may further include a voltage generator 415. The voltage generator 415 may generate a first bias voltage BIAS11 and a second bias voltage BIAS12, and the voltage generator 415 may provide the first bias voltage BIAS11 and the second bias voltage BIAS12 to the reception circuit 414. The reception circuit 414 may generate a constant current based on the first bias voltage BIAS11 and the second bias voltage BIAS12. The voltage generator 100, illustrated in FIG. 1, may be applied as the voltage generator 415.

The second semiconductor apparatus 420 may include a first reception circuit (RX) 422, a transmission circuit (TX) 423 and a second reception circuit (RX) 424. The first reception circuit 422 may be electrically coupled to the first bus 401 and may receive the first signal TS1 transmitted from the first semiconductor apparatus 410 through the first bus 401. The first reception circuit 422 may generate an internal signal, which is to be used within the second semiconductor apparatus 420, by differentially amplifying the first signal TS1 transmitted through the first bus 401. When a pair of differential signals is transmitted through the first bus 401, the first reception circuit 422 may generate the internal signal by differentially amplifying the first signal TS1 and the complementary signal TS1B of the first signal TS1. When a single-ended signal is transmitted through the first bus 401, the first reception circuit 422 may generate the internal signal by differentially amplifying the first signal TS1 and a second reference voltage VREF2. The second reference voltage VREF2 may have a voltage level corresponding to the middle of a range, within which the first signal TS1 swings. The transmission circuit 423 may be electrically coupled to the second bus 402 and may drive, based on an internal signal of the second semiconductor apparatus 420, the second bus 402 to transmit the second signal TS2 to the first semiconductor apparatus 410. The second reception circuit 424 may be electrically coupled to the second bus 402 and may receive the second signal TS2 transmitted from the first semiconductor apparatus 410 through the second bus 402. The second reception circuit 424 may generate an internal signal, which is to be used within the second semiconductor apparatus 420, by differentially amplifying the second signal TS2 transmitted through the second bus 402. When a pair of differential signals is transmitted through the second bus 402, the second reception circuit 424 may generate the internal signal by differentially amplifying the second signal TS2 and the complementary signal TS2B of the second signal TS2. When a single-ended signal is transmitted through the second bus 402, the second reception circuit 424 may generate the internal signal by differentially amplifying the second signal TS2 and the first reference voltage VREF1. The amplification circuit 300, illustrated in FIG. 3, may be applied as at least one between the first reception circuit 422 and the second reception circuit 424. The second semiconductor apparatus 420 may further include a voltage generator 425. The voltage generator 425 may generate a first bias voltage BIAS21 and a second bias voltage BIAS22 and may provide the first bias voltage BIAS21 and the second bias voltage BIAS22 to the first reception circuit 422 and the second reception circuit 424. Each of the first reception circuit 422 and the second reception circuit 424 may generate a constant current based on the first bias voltage BIAS21 and the second bias voltage BIAS22. The voltage generator 100, illustrated in FIG. 1, may be applied as the voltage generator 425.

While certain embodiments have been described above, it will be understood to those skilled in the art that the embodiments described are by way of example only. Accordingly, the voltage generator, semiconductor apparatus and semiconductor system using the same should not be limited based on the described embodiments. Rather, the voltage generator, semiconductor apparatus and semiconductor system using the same described herein should only be limited in light of the claims that follow when taken in conjunction with the above description and accompanying drawings.

What is claimed is:

1. A voltage generator comprising:

a bias voltage generation circuit configured to generate a first bias voltage based on a reference current and generate a second bias voltage based on the first bias voltage; and a compensation circuit configured to change a voltage level of the first bias voltage based on the second bias voltage, wherein the compensation circuit raises the voltage level of the first bias voltage when a voltage level of the second bias voltage increases, and decreases the voltage level of the first bias voltage when the voltage level of the second bias voltage decreases.

2. The voltage generator of claim 1, further comprising a reference current source configured to generate the reference current based on a reference voltage.

3. The voltage generator of claim 2, wherein the reference voltage is a band-gap reference voltage generated from a band-gap reference voltage generation circuit.

4. The voltage generator of claim 2, wherein the bias voltage generation circuit includes:

a current duplication circuit configured to generate a duplicated current by duplicating the reference current;

a first bias voltage output circuit configured to generate the first bias voltage based on the duplicated current; and a second bias voltage output circuit configured to generate the second bias voltage based on the first bias voltage.

5. The voltage generator of claim 4, wherein the current duplication circuit includes:

a first transistor electrically coupled between a first power voltage terminal and the reference current source; and a second transistor electrically coupled between the first power voltage terminal and a first output node, and wherein gates of the first transistor and the second transistor are coupled in common to the reference current source.

6. The voltage generator of claim 5, wherein the first bias voltage output circuit includes a third transistor electrically coupled between the first output node and a second power voltage terminal, and electrically coupled to the first output node at its gate, and wherein the first bias voltage is output from the first output node.

7. The voltage generator of claim 6, wherein the second bias voltage output circuit includes:

a fourth transistor electrically coupled between a second output node and the second power voltage terminal, and electrically coupled to the first output node at its gate; and a fifth transistor electrically coupled between the first power voltage terminal and the second output node, and electrically coupled to the second output node at its gate, and wherein the second bias voltage is output from the second output node.

8. The voltage generator of claim 7, wherein the compensation circuit is electrically coupled between the first power voltage terminal and the first output node, and adjusts an amperage flowing from the first power voltage terminal to the first output node based on the second bias voltage.

9. The voltage generator of claim 1, wherein the compensation circuit further receives a first control signal and a second control signal, and adjusts the voltage level of the first bias voltage based on the second bias voltage, the first control signal and the second control signal.

10. The voltage generator of claim 1, wherein the compensation circuit includes:

a voltage division circuit configured to generate a division voltage by dividing a first power voltage based on a first control signal;

a current circuit configured to receive the division voltage with a current driving ability of the current circuit being adjusted based on the second bias voltage; and a switching circuit configured to, based on a second control signal, provide a current to a node from which the first bias voltage is output.

11. A voltage generator comprising:

a bias voltage generation circuit configured to generate a first bias voltage based on a reference current and generate a second bias voltage based on the first bias voltage; and a variable current source configured to, based on a voltage level of the second bias voltage and control signals, adjust an amperage provided to a node from which the first bias voltage is output, wherein the variable current source increases an amperage applied to a node, from which the first bias voltage is output, as the voltage level of the second bias voltage increases, and decreases the amperage applied to the node as the voltage level of the second bias voltage decreases.

12. The voltage generator of claim 11, wherein the bias voltage generation circuit includes:

a current duplication circuit configured to generate a duplicated current by duplicating the reference current;

a first bias voltage output circuit configured to generate the first bias voltage based on the duplicated current; and a second bias voltage output circuit configured to generate the second bias voltage based on the first bias voltage.

13. The voltage generator of claim 12, wherein the current duplication circuit includes:

a first transistor electrically coupled between a first power voltage terminal and a reference current source which generates the reference current; and a second transistor electrically coupled between the first power voltage terminal and a first output node, and wherein gates of the first transistor and the second transistor are coupled in common to the reference current source.

14. The voltage generator of claim 13, wherein the first bias voltage output circuit includes a third transistor electrically coupled between the first output node and a second power voltage terminal, and electrically coupled to the first output node at its gate, and wherein the first bias voltage is output from the first output node.

15. The voltage generator of claim 14, wherein the second bias voltage output circuit includes:

a fourth transistor electrically coupled between a second output node and the second power voltage terminal, and electrically coupled to the first output node at its gate; and a fifth transistor electrically coupled between the first power voltage terminal and the second output node, and electrically coupled to the second output node at its gate, and wherein the second bias voltage is output from the second output node.

16. The voltage generator of claim 11, further comprising:

a band-gap reference voltage generation circuit configured to generate a reference voltage having a predetermined voltage level; and a reference current source configured to generate the reference current having a predetermined amperage based on the reference voltage.

17. A voltage generator comprising:

a bias voltage generation circuit configured to generate a first bias voltage based on a reference current and generate a second bias voltage based on the first bias voltage; and a variable current source configured to, based on a voltage level of the second bias voltage and control signals, adjust an amperage provided to a node from which the first bias voltage is output, wherein the control signals includes a first control signal and a second control signal, and wherein the variable current source includes:

a voltage division circuit configured to generate a division voltage by dividing a first power voltage based on the first control signal;

a current circuit configured to receive the division voltage, current driving ability of the current circuit being adjusted on a basis of the second bias voltage; and a switching circuit configured to, based on a second control signal, provide a current to a node from which the first bias voltage is output.

18. A voltage generator comprising:

a current duplication circuit configured to generate a duplicated current by duplicating a reference current;

a first transistor coupled between a first output node and a second power voltage terminal and having a gate coupled to the first output node, a first bias voltage being outputted through the first output node;

a second transistor coupled between a second output node and the second power voltage terminal and having a gate coupled to the first output node, a second bias voltage being outputted through the second output node;

a third transistor coupled between a first power voltage terminal and the second output node and having a gate coupled to the second output node; and a compensation circuit configured to change a voltage level of the first bias voltage based on the second bias voltage.

* * * * *